United States Patent [19]

Minardi

[11] Patent Number: 4,600,106

[45] Date of Patent: Jul. 15, 1986

[54] SEPARATION OF MOLDED PARTS FROM CONNECTORS

[76] Inventor: Maurice Minardi, Box 218, Carlton City, Mass. 01508

[21] Appl. No.: 552,738

[22] Filed: Nov. 17, 1983

[51] Int. Cl.[4] ..... B07C 5/06; B07C 5/12

[52] U.S. Cl. ..... 209/662; 209/668; 209/670; 209/671; 209/673; 241/159; 225/97

[58] Field of Search ..... 225/97; 241/159, 235; 209/61, 67, 70, 662, 667, 668, 669, 671, 672, 673, 691, 694, 670

[56] References Cited

U.S. PATENT DOCUMENTS

| | | | |
|---|---|---|---|
| 582,456 | 5/1897 | Christ | 209/662 |
| 1,466,015 | 8/1923 | Hartley et al. | 209/668 |
| 1,647,812 | 11/1927 | Raun | 209/673 |
| 1,647,816 | 11/1927 | Riddell | 209/668 |
| 2,082,302 | 6/1937 | Ross | 209/662 X |
| 2,646,935 | 7/1953 | Hill | 241/159 X |
| 2,786,574 | 3/1957 | Clark | 209/668 |
| 3,261,741 | 7/1966 | Bidwell | 241/159 X |
| 3,770,123 | 11/1973 | Mraz | 209/668 |
| 3,799,460 | 3/1974 | Medelberg | 209/673 X |
| 4,389,927 | 6/1983 | Crompton | 209/673 X |

*Primary Examiner*—Frank T. Yost

*Attorney, Agent, or Firm*—George E. Kersey

[57] ABSTRACT

A driven, rotatable cylinder (11-1) spaced from a counterstructure (**11-4, 11-2&3, 11*b*-2,3&4, 11*c*-2&2', 11B-2, 11C-2, 11-5, 11-6) to permit parts or connectors (P or C) to fall between the rotatable cylinder and the counterstructure. A continuous drive belt (16) is employed with an idler (14-6**) to permit adjustment of the separation between the cylinder and the counterstructure while the cylinder is in motion.

6 Claims, 15 Drawing Figures

FIG. 9
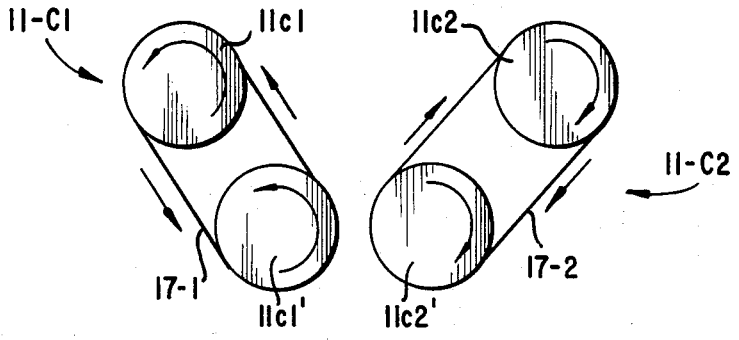
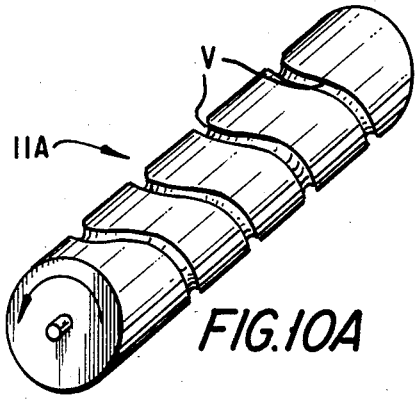
FIG. 10A
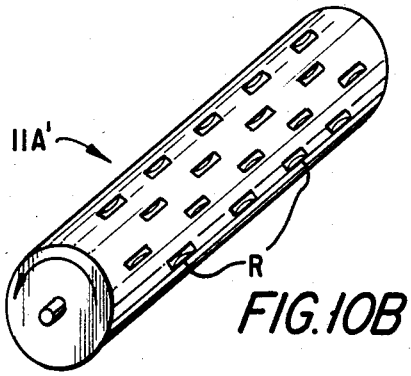
FIG. 10B
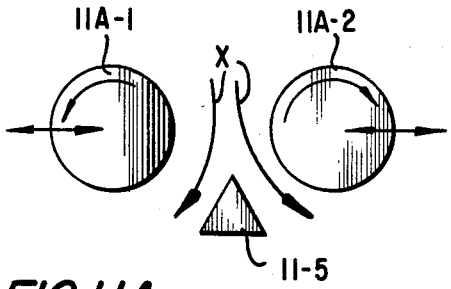
FIG. 11A
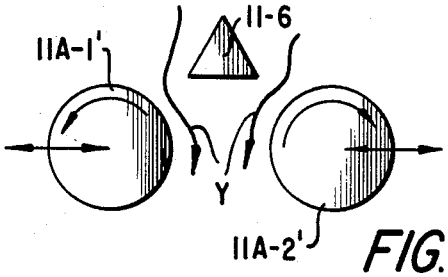
FIG. 11B
FIG. 8
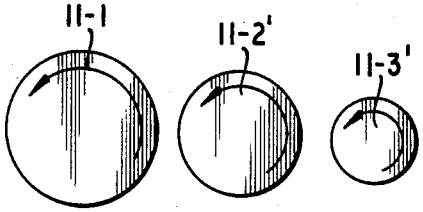

SEPARATION OF MOLDED PARTS FROM CONNECTORS

BACKGROUND OF THE INVENTION

This invention relates to the separation of molded parts from connectors, and, more particularly, to the separation of products from byproducts produced during the molding process.

In the production of parts by molding; molten material is forced into the cavities of a mold through openings called sprues and channels called runners. When the material has cooled sufficiently, the mold is opened and the desired product is expelled, along with byproduct runners and sprues. The latter represents waste material which must be separated from the product. This can be done manually but it is time consuming and inefficient.

One technique for the automatic separation of molded parts from sprue and runner connectors is disclosed in U.S. Pat. No. 3,663,142 which issued May 16, 1972. This separator makes use of a conveyor to feed both the parts and connectors from a mold to a set of coaxial disks on a shaft at the end of, and perpendicular to, the conveyor axis feed. The disks are spaced so that the parts will fall between them for collection, but the byproduct connectors will not. The latter are instead conveyed by scalloped or serrated peripheries of the disks to a waste collection station.

In a variant of the disk system, a drum with flexible lift pins is substituted for the disks. The spacing of the pins is in accordance with the spacing of the disks. The desired objects fall between the pins and the waste product is carried by the pins to a collection position.

Other machines for the separation of molded parts from connectors are disclosed in U.S. Pat. No. 4,264,012 which issued Apr. 28, 1981. In one machine a rotatable coil conveyor is used. This permits the parts to be separated by falling through the openings in the coil while the connectors are advanced by the conveyor in the direction of its axis of rotation to a collection station. To separate relatively small parts from connectors a cylinder can be mounted within the coil.

In the foregoing separators there is the possibility that an unwanted connector will fall between the disks or through the openings of the coil, and be collected with the wanted parts. In addition, the first two forms of separators are primarily suitable for the separation of production parts from byproducts where there are comparatively large differences in sizes between the parts and the byproducts. When it is desired to separate relatively small parts, adjustments must be made, such as the use of an internal cylinder with the coil separator. In all cases, a change in jobs requires a time consuming substitution of disks or coils.

Another object of the invention is to facilitate change in separational requirements, so that the separator can be adjusted readily to accommodate parts and connectors of varying sizes without requiring stoppage of the machine and the substitution of alternative parts.

Other separation techniques, although not for the separation of molded parts from connectors, are illustrated by the following U.S. Pat. Nos.: 4,389,927; 3,884,800; 3,874,508; 3,731,841; 3,519,129; 3,287,472; 3,260,364; 3,172,588; 3,121,191; 3,023,898; 3,976,550; 3,733,479; 1,745,318; and 622,035.

SUMMARY OF THE INVENTION

In accomplishing the foregoing and related objects, the invention provides for using a rotatable cylinder with a baffle that extends along the clinder for deflecting molded parts and connectors onto the cylinder. A countermember is spaced from the cylinder to permit one set of elements, either parts or connectors, deflected from the baffle to fall between the member and the cylinder. The elements of the other set, either connectors or parts, are conveyed along the cylinder and collected at an output.

In accordance with one aspect of the invention, the rotatable cylinder has a kinetic or dynamic coefficient of friction in the range above about 0.5. This promotes the separation of the molded parts from the associated connectors.

In accordance with a further aspect of the invention, the countermember can be formed by a plurality of cylinders one of which can rotate in the same sense as the first rotatable cylinder, or in an opposite sense.

In accordance with yet another aspect of the invention, the cylinders may have equal or unequal diameters, or they may be assembled into groups of cylinders so that a first plurality or cylinders is arranged in a bank that is separated by a prescribed distance from a second plurality of cylinders in a second bank.

In accordance with still another aspect of the invention, the separation of the connectors from the molded parts may be facilitated by an air blast directed between the displacement of the rotatable cylinder from the countermember, or by aperturing the rotatable cylinder to permit an air stream to be directed radially outward.

In accordance with a still further aspect of the invention, the rotatable cylinder or cylinders may be adjusted relative to one another, or to a countermember while there is cylindrical motion. For that purpose an endless drive member, such as a drive chain, extending from the first rotating cylinder through a spring loaded idler and then to a second rotatable cylinder before returning to the drive motor. This arrangement allows a rotatable cylinder to be mounted on an adjustable platform which can be moved away from or towards another cylinder or counter member while they are in motion. The idler, with its spring loading, takes up any slack in the drive member.

In accordance with yet another aspect of the invention, the baffle that extends along the rotatable cylinder is positioned away from or in the vicinity of the apex of the cylinder. The apex is the highest point reached by the cylinderical periphery during rotation. This positioning assures that the parts and connectors which are deflected from the baffle will be deflected upon a positive slope surface through the separational operation.

In accordance with a further aspect of the invention, the rotation of the cylinder and/or countermember can produce a cooling effect which promotes the dimensional stability of the product. The cooling effect can be enhanced by configuring the rotating members to create a turbulent flow of air, or by the use of external devices such as blowers and the like which also create the desired air turbulence. The dimensional stability of the product is improved by this kind of action since the cooling effect of the turbulent flow increases the rate at which the desired skin hardening effect takes place, to thereby fix the external dimensions of the product and reduce the tendency for changes in the external dimensions to take place during subsequent processing.

DESCRIPTION OF THE DRAWINGS

Other aspects of the invention will become apparent after considering several illustrative embodiments, taken in conjunction with the drawings in which:

FIG. 1A is a perspective view of a parts separator in accordance with the invention;

FIG. 8 is a further embodiment of the invention in which cylinders of different sizes are employed;

FIG. 9 is a schematic view showing belt driven rotatable cylinders in accordance with the invention;

FIG. 10A is a perspective view of a reverse auger cylinder in accordance with the invention;

FIG. 10B is a perspective view of a rotatable cylinder with half-moon grooves for the agitation of parts in accordance with the invention;

FIG. 11A is a schematic view of a pair of rotatable cylinders with a center baffle in accordance with the invention; and FIG. 11B is a schematic view of an alternative arrangement of FIG. 11A.

DETAILED DESCRIPTION

With reference to the drawings, a parts separator 10 in accordance with the invention is shown in FIG. 1A. The separator 10 includes a plurality of cylinders 11-1, 11-2 and 11-3 which are mounted within a frame 12. At the sides of the frame 12 are respective baffles 13-1 and 13-3. Various ones of the cylinders 11-1 through 11-3 are rotated in accordance with the desired operation of the separator 10. The parts P and the connectors C which are to be separated are deposited upon the baffles 13-1 and 13-3, and the rollers 11-1 through 11-3 from above in the direction indicated by the Arrow D. Depending upon the spacing between the first and second cylinders 11-1 and 11-2, and the second and third cylinders 11-2 and 11-3, the parts P or the connectors C fall into collection trays or conveyors below the cylinders (not shown) and the other components, either the parts P or the connectors C, are conveyed along the cylinders in the direction indicated by the arrow E to the output end of the machine 10 where they are collected.

In the usual operation the gap g1 between the first and second cylinders 11-1 and 11-2 and the similar gap g2 between the second and third cylinders 11-2 and 11-3 is adjusted to permit the parts P to fall between the cylinders for collection, while the connectors are conveyed to the output end E. In some cases where the parts P are of two sizes the gaps g1 and g2 will be different and the parts P and connectors C will be deposited between the cylinders forming the smaller gap, with the intermediate cylinder 11-2 serving to rotate the larger parts P to the larger gap. The baffles 13-1 and 13-3 move simultaneously with their associated cylinders 11-1 and 11-3.

In general the parts P and connectors C are deposited upon either baffle 13-1 or 13-3 from which they are deflected to one or more of the cylinders 11-1 through 11-3.

Figure 1B:
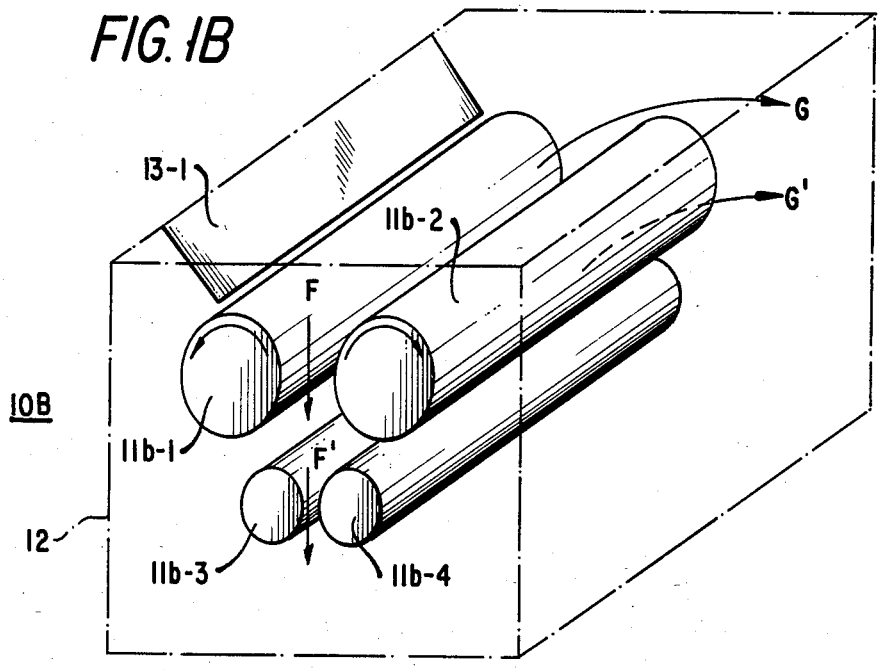
FIG. 1B is a perspective view of a partial alternative parts separator in accordance with the invention.
Figure 1C:
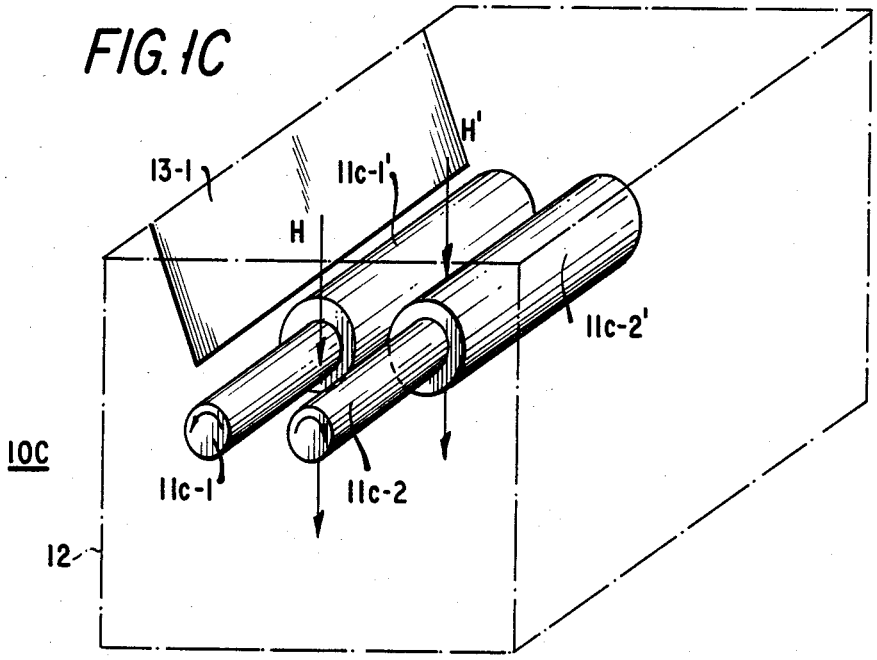
FIG. 1C is a perspective view of a partial further alternative parts separator in accordance with the invention.

Alternative embodiments of the invention are shown in FIGS. 1B and 1C. In the case of FIG. 1B four rolls **11*b*-1 through 11*b*-4 are employed. Two larger rolls 11*b*-1 and 11*b*-2 are positioned above two smaller rolls 11*b*-3 and 11*b*-4. This arrangement is particularly suitable for family molds and achieves multiple bank separation. The parts and byproducts are initially deposited upon the larger upper rolls 11*b*-1 and 11*b*-2. The parts fall between the rolls 11*b*-1 and 11*b*-2 in the direction indicated by the arrow F. The byproducts are conveyed between and along the rolls 11*b*-1 and 11*b*-2, and are discharged at an output end indicated by the arrow G. The multiple sized parts which are deposited on the lower rolls 11*b*-3 and 11*b*-4** are subjected to a further separation, with the smaller parts falling between the rolls in the direction indicated by the arrow F' and the larger parts are conveyed by the rolls to an output end indicated by the arrow G'.

In the further alternative embodiment indicated by FIG. 1C the rolls **11*c*-1 and 11*c*-2 have increasing stepped diameters, so that the larger parts can fall between the frontal portions of the rolls 11*c*-1 and 11*c*-2, while the smaller parts fall between the enlargements 11*c*-1' and 11*c*-2'. In the case of FIG. 1C the byproducts are propelled forwardly and discharged at the smaller end of the rollers 11*c*-1 and 11*c*-2. For that purpose the forward ends of the rolls are at a small angle of declination on the order of two degrees, with respect to the enlarged ends 11*c*-1' and 11*c*-2'**. As a result the byproducts move by gravity action towards the front of the separator and are suitably collected.

Figure 2:
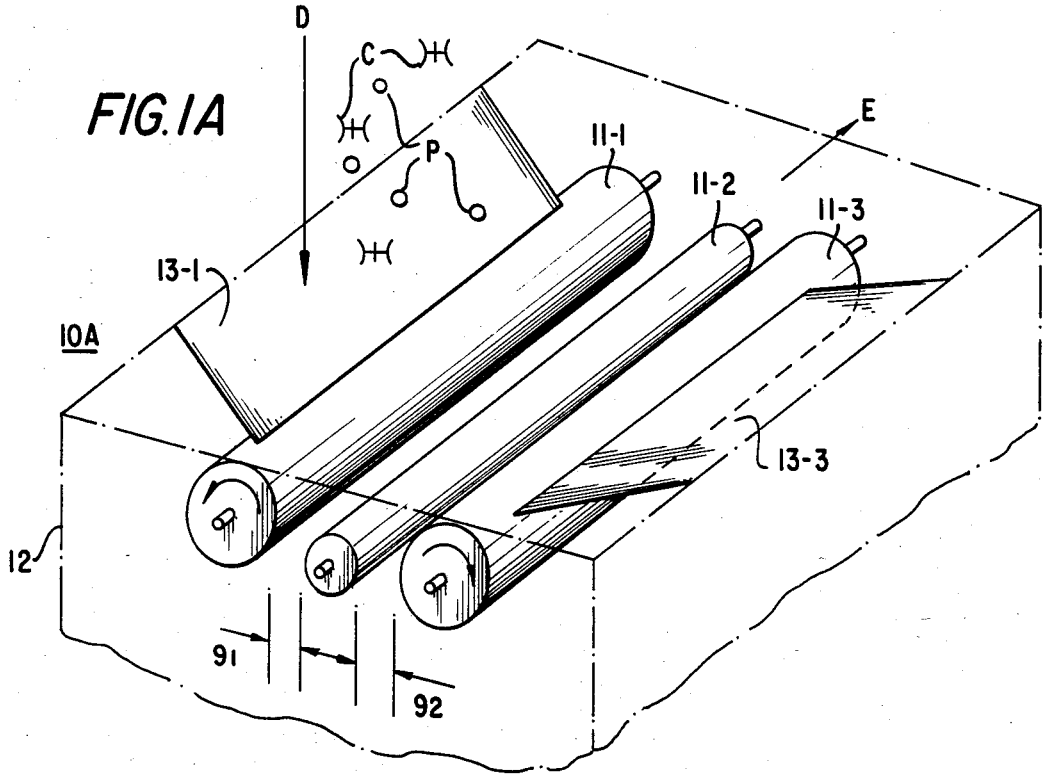
FIG. 2 is a perspective view showing the rotatable cylinders, baffle and drive arrangement for the separator of FIG. 1A.
Figure 2:
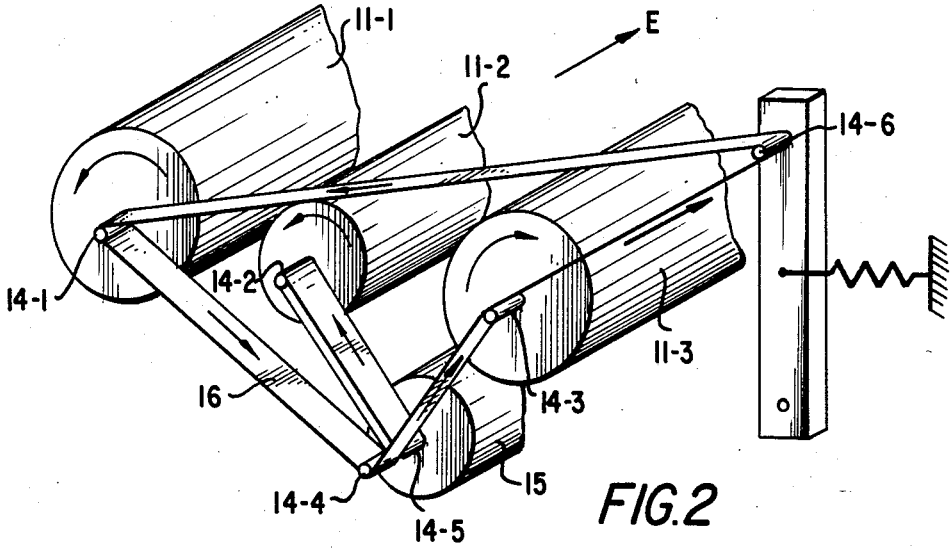

At illustrative drive arrangement for the cylinders 11-1 through 11-3 is shown in FIG. 2. Each of the cylinders includes a corresponding drive element 14-1, 14-2 and 14-3. The drive elements 14-1 through 14-3 are rigidly coupled to their associated cylinders 11-1 through 11-3. The motive force for driving selected ones of the cylinders 11-1 through 11-3 is provided by a motor 15 with an associated drive element 14-4. The drive member 16 is acted upon by the motor element 14-4 and transmit torque to the first drive element 14-1 of the cylinder 11-1 as well as to the third drive element 14-3 of the third cylinder 11-3. In order to provide for opposite senses of rotation of the cylinders 11-1 and 11-3, as well as permit continuous adjustment while in operation, an idler element 14-6 is employed so that the drive member 16 extends directly from the first drive element 14-1 to the idler 14-6 and then to the third drive element 14-3. The drive loop is completed by return of the drive member 16 to the motor drive element 14-4. Illustratively when the drive member 16 is rotated in a counterclockwise direction as indicated by the associated arrows, the first cylinder 11-1 is also rotated in a counterclockwise direction while the third cylinder 11-3 is rotated in a clockwise direction. Where it is desired to drive the intermediate cylinder 11-2, a further drive element 14-5 may be employed in connection with a drive member 16 that is directly coupled to the drive element 14-2 of the intermediate cylinder 11-2. Illustratively in FIG. 2 the intermediate cylinder is driven in a counterclockwise direction. The arrangement shown in FIG. 2 is therefore suitable for separating two different sizes of parts P which are initially desposited on the baffle 13-3 and then deflected to the opening between the cylinders 11-2 and 11-3. The smaller parts drop through the opening and the larger parts are carried by the intermediate rotating cylinder 11-2 to the gap between that cylinder and the first cylinder 11-1. The larger parts then fall through that gap. In all cases the still larger connecting parts C are conveyed along the cylinders to the output end E.

It will be appreciated that in situations where the connectors are smaller than the parts P, it is the connectors C which pass through the gaps between the various cylinders 11-1 through 11-3 and it is the parts which are conveyed along the cylinders to the output end E.

In order to promote the conveyance of either the parts P or the connectors C, it is desirable for the input end of the machine 10 to be elevated slightly above the output end E. A suitable elevation is on the order of two degrees of elevation. In addition, it is desirable for the surfaces of the cylinders 11-1 through 11-3 to have a suitable degree of roughness, approximately 250 RMS or less. The measure of roughness (RMS-"Roughness of Metal Surface") is determined in accordance with the standard testing methods of the ASME (American Society of Mechanical Engineers) for which smoothness increases as the index number increases. This is to provide agitation of the parts and connectors deflected from the baffle and promote their separation so that they may be conveyed to their respective collection stations without undue interference which could be caused by the sticking of parts to connectors. A suitable degree of roughness is achieved by making the coefficient of kinetic friction for the surface of each rotatable cylinder above about 0.5.

Figure 3:
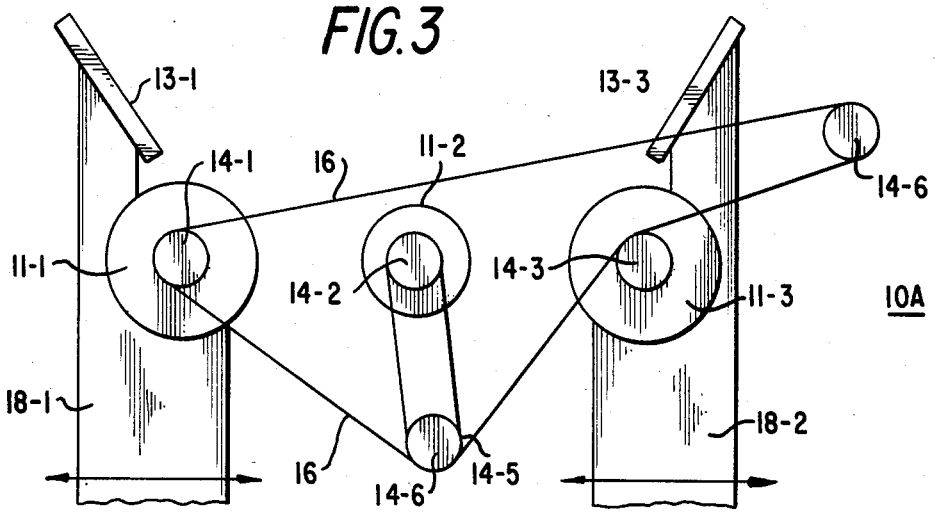
FIG. 3 is a schematic view of the drive system which permits adjustment during the rotation of the cylinders of FIG. 2.

As indicated by the end view of the drive mechanism shown in FIG. 3, the outer cylinders 11-1 and 11-3 are adjustable, either simultaneously or independently, with respect to the center cylinder 11-2 while the mechanism is in motion. This permits accommodation of the separator 10 to changes in job requirements without the need to stop the machine and change components. For that purpose, as indicated in FIG. 3, the drive ends of the cylinders 11-1 and 11-3 are movable by adjustment of a supporting post 18-1 for the cylinder 11-1 and 18-3 for the cylinder 11-3. It is also to be noted that the idler element 14-5 is mounted on a spring loaded arm 19-1 which is connected to a tensioning spring 19-2 to accommodate the various changes in position made by motion of the pedestals 18-1 and 18-3. In addition, it is desirable for the same screw thread to be used for both pedestals by providing threads with a first sense of rotation for the pedestal 18-1 and an opposite sense of rotation for the pedestal 18-3. In this way rotation of the crank in one direction effects differential separation of the rotating cylinders 11-1 and 11-3 in equal magnitudes. It is also possible to have independent adjustment of the pedestals.

Figure 4:
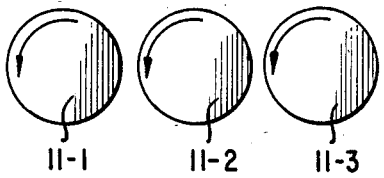
FIG. 4 is a schematic diagram illustrating an alternative mode of cylindrical operation with cylinders having the same direction of rotation.

It will be appreciated that the directions of rotation for the cylinders 11-1 through 11-3 in FIGS. 1 and 2 are merely illustrative. As previously noted, the center cylinder 11-2 may be stationary or rotatable either in a clockwise or counterclockwise direction. In addition, as indicated in FIG. 4, all three of the cylinders 11-1 through 11-3 may have the same sense of rotation which is illustrated as being counterclockwise, although clockwise rotation may be employed as well.

Figure 5:
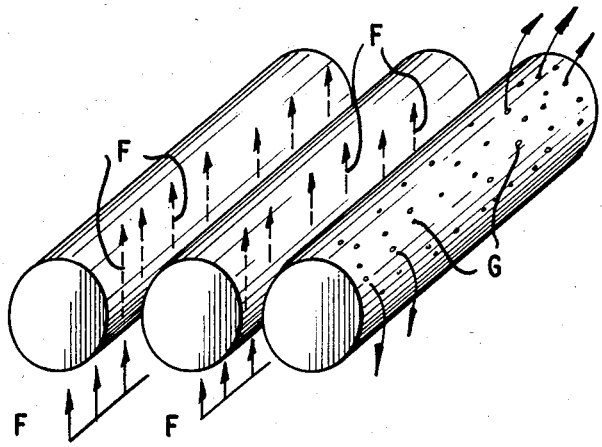
FIG. 5 is a partial perspective view showing various adaptations for applying an air stream to facilitate separation of the molded parts from the connectors.

A further embodiment of the invention is illustrated in FIG. 5. As previously noted, it is advantageous for the surfaces of the cylinders 11-1 through 11-3 to have a roughened surface. While the cylinders have a coefficient of kinetic friction at their surfaces of less than about 0.5, it is advantageous to effect agitation of the parts P and connectors C by an auxiliary air blast indicated by the arrows F or by using the air blast in connection with apertures G in the cylindrical surfaces. The air blast may also be used to transport the by-product parts.

Figure 6:
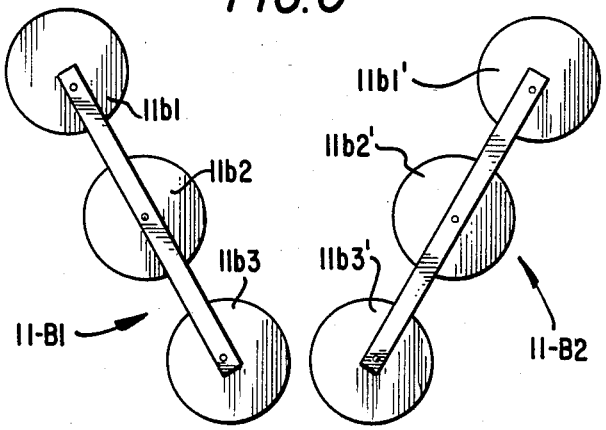
FIG. 6 is a schematic view of a further embodiment of the invention in which each rotatable cylinder is replaced by a cylindrical bank.
Figure 7:
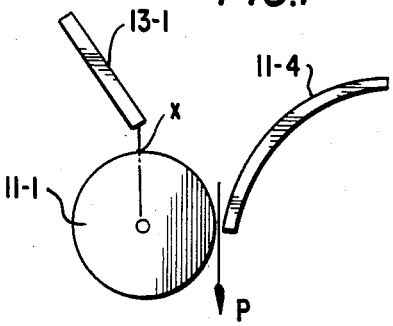
FIG. 7 is a further embodiment of the invention in which the countermember is in the form of a curved baffle that is spaced from the rotatable cylinder.

Moreover, each of the individual cylinders 11-1 and 11-2 in FIGS. 1 and 2 may be replaced by a bank of cylinders as shown in FIG. 6. In FIG. 6 the first cylinder 11-1 has been replaced by a first bank 11-B1 with individual cylinders **11-*b*1, 11-*b*2 and 11-*b*3. The second cylinder 11-2 is substituted by a second bank 11-B2 with individual cylinders 11-*b*1', 11-*b*2' and 11-*b*3'. The invention may also be practiced by using a single cylinder 11-1 as shown in FIG. 7. It is desirable for the associated baffle 13-1 to be positioned in the vicinity of the apex X of the cylinder 11-1. The apex is the highest position reached by a surface element of the cylinder 11-1 during rotation. In FIG. 7 the cylinders 11-2 and 11-3 have been substituted by a curved baffle 11-4. Separation takes place as described previously with, for example, the parts P falling between the gap of the baffle 11-4 with respect to the rotating cylinder 11-1**.

It will also be appreciated that the cylinders may be of different sizes as illustrated in FIG. 8 where the intermediate cylinder 11-2' is smaller than the primary cylinder 11-1, and the outer cylinder 11-3' is smaller than the intermediate cylinder 11-2'. While various combinations of cylinder size are possible particularly suitable results are achieved when the smallest diameter cylinder occupies an intermediate position.

Another embodiment of the invention is shown in FIG. 9 where the cylinders are disposed in two banks 11-C1 and 11-C2. By contrast with the cylindrical banks of FIG. 6, those of FIG. 9 are belt driven by respective belts 17-1 and 17-2.

Another embodiment of the invention is illustrated by the cylinder 11A of FIG. 10A. The cylinder 11A is in a reverse auger configuration so that the cylindrical grooves V rotate in a direction opposite to their conventional rotation. This is because the cylinder 11A of FIG. 10A is illustrated as rotating in a counterclockwise direction. Since the grooves V have a right-hand sense of threading, they normally would be accompanied by a clockwise rotation, instead of the counterclockwise rotation that is illustrated. Because of the counterclockwise rotation of the right-hand auger grooves V, the separation of parts is promoted. Another cylinder 11A' for promoting separation of parts is shown in FIG. 10B where the surface of the cylinder 11A' is provided with a set of half-moon recesses R.

A further embodiment of the invention is illustrated in FIG. 11A where the intermediate roll 11-2 of FIG. 1A has been substituted by a triangular baffle 11-5. The separation of parts in FIG. 11A takes place in the direction indicated by the arrows X. The respective cylinders 11A-1 and 11A-2 are adjustable relative to the baffle 11-5 as indicated by the double-headed arrows. It will be appreciated that the baffle 11-5 may occupy other positions relative to the associated cylinders as illustrated by FIG. 11B. In FIG. 11B the baffle 11-6 has been moved above the associated cylinders 11A-1' and 11A-2'. The feed path for the parts being separated is illustrated by the arrows Y.

While various aspects of the invention have been set forth in the drawings and specification, it is to be understood that the foregoing detailed description is for illustration only and that various changes in parts, as well as the substitution of equivalent constituents for those shown and described may be made without departing from the spirit and scope of the invention as set forth in the appended claims.

What is claimed is:

1. Apparatus for the precision separation of molded parts from connectors, which comprises a first rotatable cylinder;

a rotatable countermember spaced from said first rotatable cylinder by a prescribed amount to permit either said molded parts or said connectors to fall through the spacing;

a second rotatable cylinder spaced from said countermember by a prescribed amount to permit said molded parts or said connectors to fall between said second cylinder and said countermember;

a continuous drive member connecting a drive motor to the first and second cylinders with a intermediate idler so that the cylinders rotate in opposite directions; and means for rotating said countermember by said drive motor.

2. Apparatus as defined in claim 1 wherein said rotatable cylinders and said countermember are elevated at one end thereof;

3. Apparatus as defined in claim 1 wherein said rotatable cylinders have a surface coefficient kinetic friction above 0.5.

4. Apparatus as defined in claim 1 including means for adjusting said rotatable cylinders while the cylinders are in motion.

5. Apparatus as defined in claim 1 wherein said idler is spring loaded, said drive member extends directly from said first rotatable cylinder to said idler and then directly from said idler to said second rotatable cylinder and then to said drive motor, and the rotatable cylinders are adjustable simultaneously while said cylinders are in motion.

6. Apparatus as defined in claim 5 wherein one of the rotatable cylinders is mounted on an adjustable pedestal.

* * * * *